US009746290B2

(12) United States Patent
Kuo

(10) Patent No.: US 9,746,290 B2
(45) Date of Patent: Aug. 29, 2017

(54) INTERLOCKING TELESCOPIC ROD-TYPE DEFENSE SPRAY APPARATUS

(71) Applicants: Tai-Wang Kuo, Kaohsiung (TW); Shih-Shun Fu, Kaohsiung (TW)

(72) Inventor: Tai-Wang Kuo, Kaohsiung (TW)

(73) Assignees: Tai-Wang Kuo, Kaohsiung (TW); Shih-Shun Fu, Kaohsiung (TW)

( * ) Notice: Subject to any disclaimer, the term of this patent is extended or adjusted under 35 U.S.C. 154(b) by 0 days.

(21) Appl. No.: 15/007,652

(22) Filed: Jan. 27, 2016

(65) Prior Publication Data

US 2016/0298939 A1 Oct. 13, 2016

(30) Foreign Application Priority Data

Apr. 13, 2015 (TW) ..... 104205520 U

(51) Int. Cl.

| | |
|---|---|
| ***B67D 7/84*** | (2010.01) |
| ***F41H 9/10*** | (2006.01) |
| ***F41H 13/00*** | (2006.01) |
| ***F41B 9/00*** | (2006.01) |
| ***F41B 15/02*** | (2006.01) |
| ***F41B 15/04*** | (2006.01) |
| ***A45B 3/00*** | (2006.01) |

(52) U.S. Cl.

CPC ..... *F41H 9/10* (2013.01); *A45B 3/00* (2013.01); *F41B 9/0037* (2013.01); *F41B 15/027* (2013.01); *F41B 15/04* (2013.01); *F41H 13/0018* (2013.01); *F41B 9/0087* (2013.01)

(58) Field of Classification Search

CPC ..... F41H 9/10; F41H 13/0018; A45B 3/00; F41B 9/0037; F41B 15/027; F41B 15/04; F41B 9/0087

USPC ..... 222/174; 135/66; 361/232; 463/47.7

See application file for complete search history.

(56) References Cited

U.S. PATENT DOCUMENTS

| | | | | |
|---|---|---|---|---|
| 3,038,483 | A * | 6/1962 | Altsheler | A45B 3/00 135/16 |
| 3,241,259 | A * | 3/1966 | McBride | F41B 15/022 42/1.08 |
| 3,432,077 | A * | 3/1969 | Voll | F41B 15/02 222/175 |
| 4,093,969 | A * | 6/1978 | Maynor, Jr. | A45B 3/00 135/34.2 |

(Continued)

*Primary Examiner* — Patrick M Buechner
*Assistant Examiner* — Michael J Melaragno
(74) *Attorney, Agent, or Firm* — Juan Carlos A. Marquez; Marquez IP Law Office, PLLC

(57) ABSTRACT

An interlocking telescopic rod-type defense spray apparatus includes: a first tube body, a cap and a second tube body. The first tube body has a receiving chamber for placing an irritant gas can. The cap covers the receiving chamber. A rod body portion of the second tube body includes an upper tube, a lower tube, and a telescopic-rod packing device connecting the upper tube and the lower tube. Two sectioned tube pieces and a spring pin component and a push joint component between the two tube pieces are applied to lock and unlock a relative position relationship between the two tube pieces, so that the defense spray apparatus has composite functions of a rod-piece additional function of a locking configuration of relative positions of the two tube pieces and a press-lever spray irritant gas can of an unlocking configuration of the relative positions of the two tube pieces.

11 Claims, 18 Drawing Sheets

(56) References Cited

U.S. PATENT DOCUMENTS 4,252,137 A * 2/1981 Cohen ..... A61H 3/02 135/69
4,819,137 A * 4/1989 Hamilton ..... F41B 15/025 362/102
4,860,776 A * 8/1989 McQuain ..... A45B 3/00 135/16
5,065,904 A * 11/1991 McCaffrey ..... F41H 9/10 135/19.5
5,282,332 A * 2/1994 Philips ..... F41H 13/0018 42/1.08
5,529,215 A * 6/1996 Banks ..... F21V 33/0064 222/113
5,842,601 A * 12/1998 Pierpoint ..... F41H 9/10 222/1
5,901,723 A * 5/1999 Ames ..... A45B 3/14 135/66
5,986,872 A * 11/1999 Chaput ..... A45B 3/00 135/16
6,091,597 A * 7/2000 Lin ..... F41B 15/04 361/115
6,386,726 B1 * 5/2002 Macierowski ..... A45B 3/00 362/102
6,499,855 B1 * 12/2002 Kukuk ..... F21V 33/0064 362/102
6,957,750 B1 * 10/2005 Trudell ..... A45B 3/14 135/66
7,421,933 B1 * 9/2008 Pearson ..... F41H 13/0018 361/232
7,525,786 B1 * 4/2009 Douglas ..... F41B 15/027 231/7
8,375,967 B1 * 2/2013 Stratton ..... A45B 3/14 135/66
9,257,026 B2 * 2/2016 Kalina ..... G08B 15/00
9,345,296 B1 * 5/2016 Lanear ..... A45B 3/14
2004/0264098 A1 * 12/2004 Eccles ..... H05C 1/00 361/232
2007/0167241 A1 * 7/2007 Stethem ..... A01K 15/02 463/47.3
2009/0038664 A1 * 2/2009 Juslin ..... A45B 3/00 135/66
2009/0199884 A1 * 8/2009 Lessing ..... A45B 3/00 135/66
2013/0015203 A1 * 1/2013 Zuloff ..... F41B 9/0037 222/113
2013/0150167 A1 * 6/2013 Pelkey ..... F41B 15/027 463/47.7
2014/0256452 A1 * 9/2014 Cheng ..... F41B 15/027 463/47.7
2015/0038239 A1 * 2/2015 Parsons ..... F41B 15/027 463/47.7
2015/0038240 A1 * 2/2015 Parsons ..... F41B 15/027 463/47.7
2016/0298939 A1 * 10/2016 Kuo ..... F41H 9/10
2016/0305747 A1 * 10/2016 Kuo ..... F41H 9/10

* cited by examiner

INTERLOCKING TELESCOPIC ROD-TYPE DEFENSE SPRAY APPARATUS

BACKGROUND

Technical Field

The present invention relates to an interlocking telescopic rod-type defense spray apparatus, and more particularly to a defense spray apparatus in which at least two sections may be pushed to each other to spray contents of an irritant gas can, and may be positioned relative to each other to be locked into a function application having a rod-type member.

Related Art

A conventional umbrella, staff or cane is easy to carry and can be used for defense; however, in a sudden strike of an armed villain, during a fierce fight, it is still possible that the villain causes death or injuries with a strike by using a bladed weapon.

In addition, a conventional device such as a gas pistol and a self-defense spray device can be used to spurt high-pressure self-defense spray at a villain at a long distance greater than 3 meters to 4 meters before the villain approaches; however, for a function or a dosage of the device, an irritant gas or liquid can only be spurted at the face of the villain for a very few seconds to take away the vision of the villain, and if the villain closes the eyes and covers the mouth and nose and keeps slashing wildly with a weapon, the gas pistol and the self-defense spray are basically useless to stop the villain. Moreover, for the purpose of portability, a self-defense spray can is generally small and has a small volume, and a dosage of an irritant gas in the self-defense spray can can support only a limited quantity of times of spurting. When the self-defense spray can is emptied after several times of spurting, if a danger still exists, an article such as an umbrella needs to be used for defense to resist an attack.

SUMMARY

An objective of the present invention is to provide an interlocking telescopic rod-type defense spray apparatus. In the interlocking telescopic rod-type defense spray apparatus, two sectioned tube pieces and a telescopic-rod packing device between the two tube pieces are applied to lock and unlock a relative position relationship between the two tube pieces, so that the defense spray apparatus has composite functions of a rod-piece additional function of a locking configuration of relative positions of the two tube pieces and a push spray irritant gas can of an unlocking configuration of the relative positions of the two tube pieces.

To achieve the foregoing objective, the present invention provides an interlocking telescopic rod-type defense spray apparatus, used to unlock telescopic rods to spray contents of an irritant gas can disposed inside the apparatus, the defense spray apparatus comprising: a first tube body, a receiving chamber being provided in an intra-tube space, having a relatively large diameter, of a head-end portion of the first tube body, an opening on an end surface of the receiving chamber being used for placing the irritant gas can, and an inner edge being provided at an opening on an end surface of a tail-end portion, to form an inwardly-shrinking hole; a cap, tightly covering the opening of the receiving chamber, the cap having a central step through hole for inserting a press-ring portion of the irritant gas can and an output tube, and a compression elastic piece being disposed between the press-ring portion and the step through hole; and a second tube body, having a rod body portion, the rod body portion comprising an upper tube, a lower tube, and a telescopic-rod packing device connecting the upper tube and the lower tube, an upper seat of the telescopic-rod packing device being fixedly connected to the upper tube, a lower seat being fixedly connected to the lower tube and having a diameter greater than that of the inwardly-shrinking hole, an eccentric shaft having two ends pivotally connected to the upper seat and the lower seat separately, and a packing ring disposed around the eccentric shaft, a top rod structure being disposed at an end, away from the upper seat, of the upper tube, and a sheath structure being fixedly disposed at an end, away from the lower seat, of the lower tube, where the second tube body is inserted from the head-end portion of the first tube body, so that the lower tube is exposed from the tail-end portion of the first tube body, the upper tube and the telescopic-rod packing device are limited inside the first tube body by using the inner edge of the inwardly-shrinking hole, the lower tube is rotated to drive a fingering plate to enable the eccentric packing ring to rotate about the eccentric shaft, so that the fingering plate pushes the packing ring and enables a thick wall of the packing ring to radially protrude from the rod body portion on a side of the eccentric shaft to tightly abut a corresponding inner wall surface of the first tube body, or the lower tube is slightly rotated in an opposite direction to drive the fingering plate to release the packing ring to enable the packing ring not to radially protrude from the rod body portion to release the corresponding inner wall surface of the first tube body, and after the telescopic-rod packing device releases the inner wall surface of the first tube body, the sheath structure of the second tube body is held and pushed toward the first tube body to enable the top rod structure to push the irritant gas can to press the press-ring portion to spray the contents.

An advantage of the present invention lies in: In the present invention, a self-defense spray can and a rod-type umbrella, staff or cane are combined, so that an irritant gas may be sprayed first and a rod-type object such as the umbrella, the staff, and the cane may then be used to resist an attack of a villain, thereby improving an effect of safety protection. In addition, during mountain climbing and walking in a mountain region or an uninhabited region, in a case of a headwind, when there is a villain, a stray dog or an animal that attacks people, if self-defense pepper spray is sprayed immediately, the spray may affect the one who sprays, so that for the rod-type structure of the cane of the present invention, the cane may be used first for defense against an attack of the villain or to drive away the animal that attacks people, and at a position of a tailwind, an irritant gas can be used to spray an irritant gas at the villain or the animal that attacks people, so that a double protection effect is achieved. Moreover, in the present invention, when a rod-type object is formed, the rod-type object itself also has a function of defense. For example, a rod piece such as a stick, an umbrella rod, and a cane is used for strikes, and an extended cloth confuses the sight of the villain or the animal that attacks people or blocks a dangerous liquid sprayed by the villains. Moreover, the present invention also has an effect of being disguised as a common rod-shaped utensil or being blended in a portable object (a utensil such as an umbrella, a cane, a short staff, a flashlight, and a golf-club) in daily lives. Therefore, an advanced apparatus that combines various defense functions is implemented.

BRIEF DESCRIPTION OF THE DRAWINGS

The disclosure will become more fully understood from the detailed description given herein below for illustration only, and thus are not limitative of the disclosure, and wherein.

DETAILED DESCRIPTION

The embodiments of the present invention are described below in detail with reference to the accompanying drawings. The accompanying drawings are simplified schematic views, and a basic structure of the present invention is described in a schematic manner. Therefore, only elements related to the present invention are labeled in the accompanying drawings, and the shown elements are not drawn according to quantities, shapes, sizes, proportions, and the like during implementation. Specifications and sizes during actual implementation of the elements are actually an optional design, and the layout and forms of the elements may be more complex.

Figure 1:
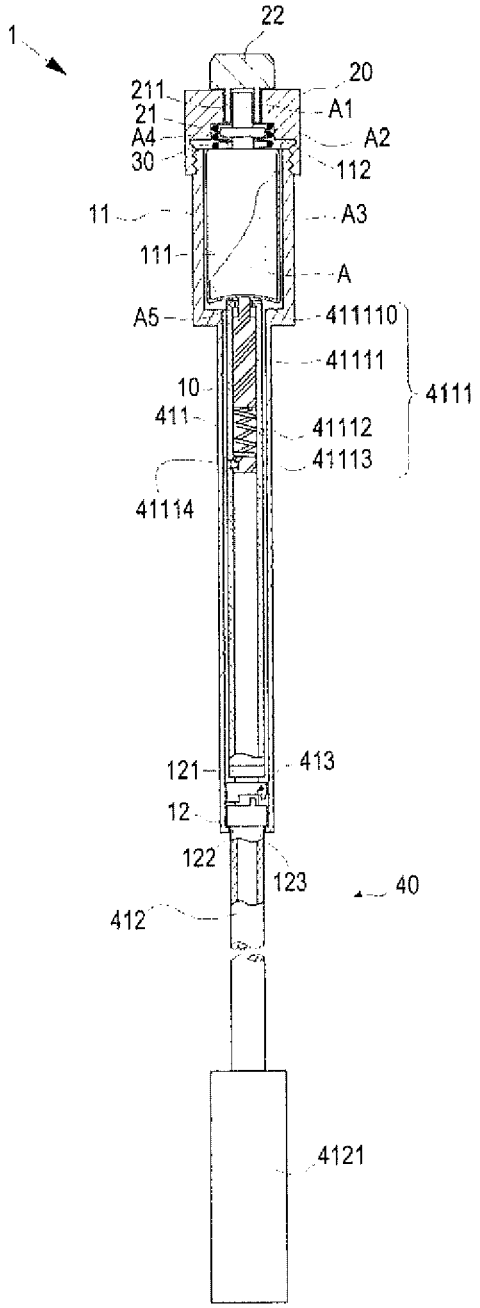
FIG. 1 is a schematic sectional view of an embodiment of a staff defense spray apparatus of an interlocking telescopic rod-type defense spray apparatus according to the present invention.
Figure 2:
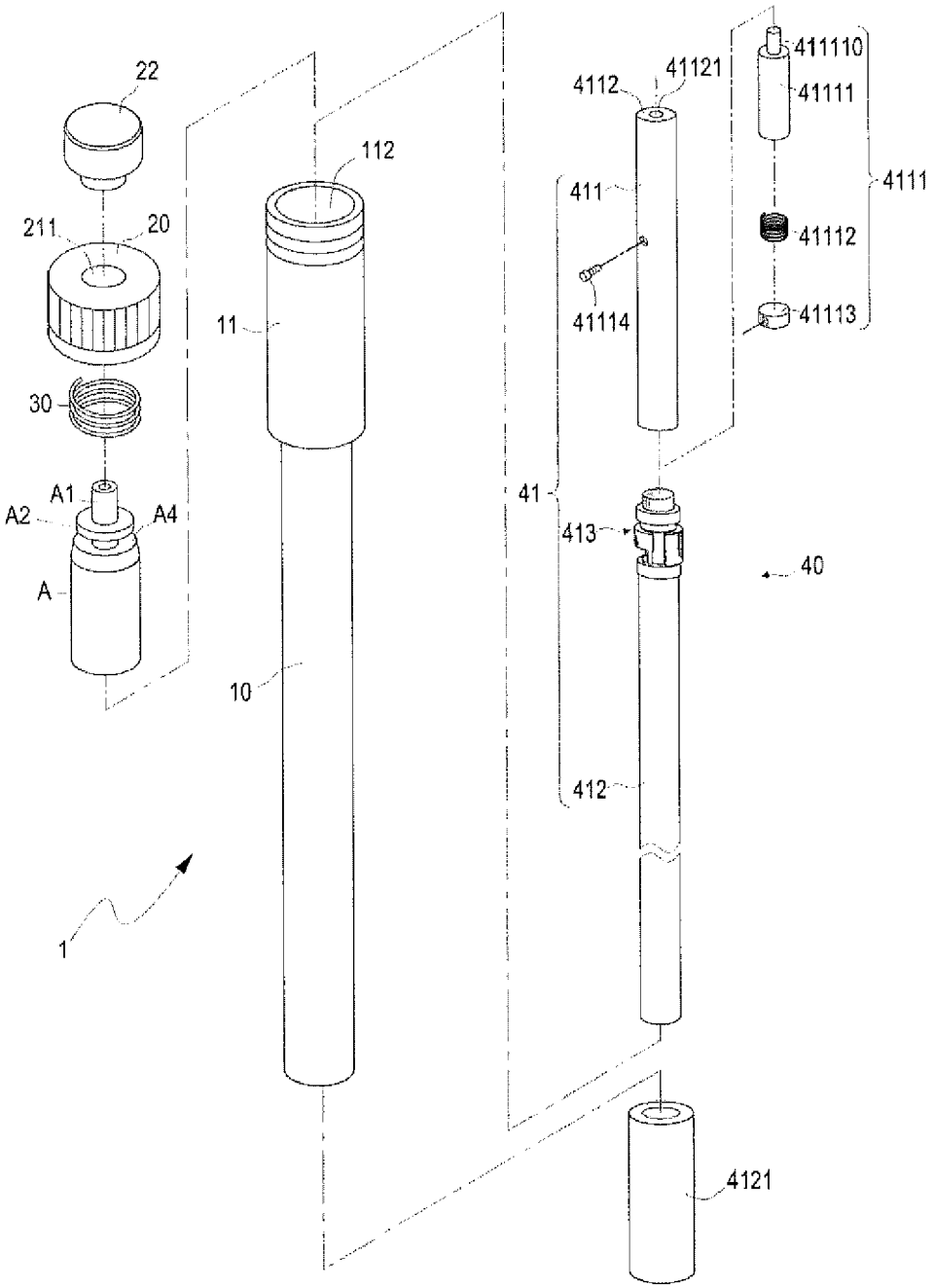
FIG. 2 is an exploded perspective view of the embodiment in FIG. 1.
Figure 3:
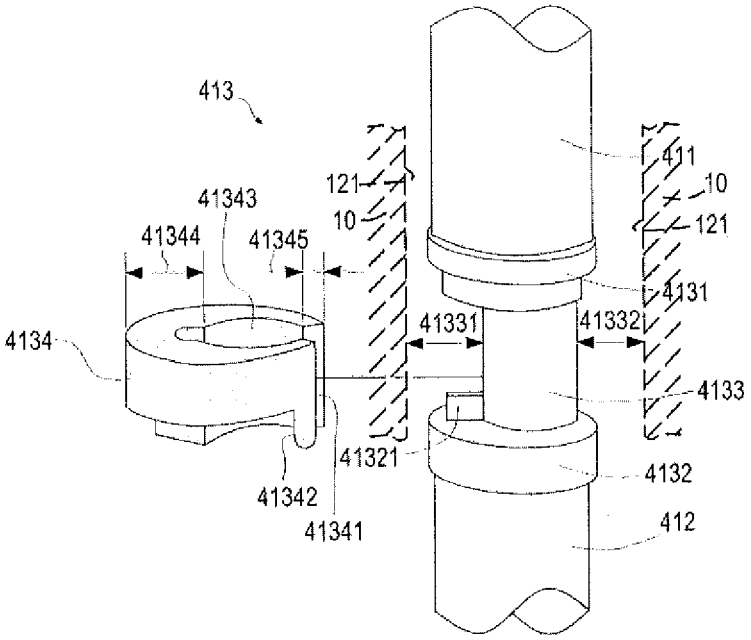
FIG. 3 is an exploded perspective view of a telescopic-rod packing device of an embodiment of an interlocking telescopic rod-type defense spray apparatus according to the present invention.

First, please refer to FIG. 1, FIG. 2, and FIG. 3. An interlocking telescopic rod-type defense spray apparatus 1 in this embodiment is a two sectioned defense rod when relative axial movement of the telescopic rods is unlocked (if a tube body of the defense spray apparatus 1 is shortened, for example, an upper tube 411 is shortened or omitted, the defense spray apparatus 1 is a portable defense short stick). After the telescopic rods are unlocked, contents A3 of an irritant gas can A disposed inside the apparatus are to be sprayed. A protruding output tube A1 is provided at a top portion of the irritant gas can A, a press-ring portion A2 is provided at a periphery of the output tube A1, and the press-ring portion A2 may be subject to an external force of pressing to spray the contents A3 axially outward from the output tube A1. The irritant gas can A can be subject to high pressure, and a can body bottom portion A5 of the irritant gas can A generally has a concave form.

The defense spray apparatus 1 includes: a first tube body 10, a cap 20, a compression elastic piece 30, and a second tube body 40. The first tube body 10 has a head-end portion 11 and a tail-end portion 12, a receiving chamber 111 is provided in an intra-tube space, having a relatively large diameter, of the head-end portion 11, an opening 112 is provided on an end surface of the receiving chamber 111 and used for placing the irritant gas can A in the receiving chamber 111, and an inner edge 122 is provided at an opening on an end surface of the tail-end portion 12, to form an inwardly-shrinking hole 123. The cap 20 tightly covers the opening 112 of the receiving chamber 111 (specifically, the cap 20 covers the opening 112 of the receiving chamber 111 in many manners; in practice, an external thread may be disposed on an outer side of an end surface of the opening 112, and a corresponding inner thread is disposed on an inner edge of the cap 20, the cap 20 then covers the opening 112 in a threaded manner, or an L groove is provided on the outer side of the end surface of the opening 112, a corresponding convex end is disposed on the inner edge of the cap 20, and the cap 20 is then pressed and rotated by a rotating angle to clamp the convex end in the L groove to cover the opening 112), a recessed seat 21 is provided at a center of a surface, facing the receiving chamber 111, of the cap 20, a through hole 211 is provided at a center of the recessed seat 21, the press-ring portion A2 of the irritant gas can A corresponds to the recessed seat 21, and the output tube A1 is aligned with the through hole 211. An end of the compression elastic piece 30 is disposed on the recessed seat 21, and the other end of the compression elastic piece 30 is kept between a can body top portion A4 of the irritant gas can A (an inner diameter of the compression elastic piece 30 is greater than a diameter of the press-ring portion A2, so that a distance is stretched between the can body top portion A4 and a bottom surface of the recessed seat 21 because of an elastic force of the compression elastic piece 30, so as to avoid that when the first tube body 10 is swung upward and downward or shaken (for example, in an subsequent application to an umbrella embodiment, an action of shaking a central rod to remove rainwater, an action of poking the ground with the cane), the press-ring portion A2 pushes the bottom surface of the recessed seat 21 to spill the contents A3 of the irritant gas can A). The second tube body 40 has a rod body portion 41, the rod body portion 41 includes an upper tube 411, a lower tube 412, and a telescopic-rod packing device 413 connecting the upper tube 411 and the lower tube 412, and the telescopic-rod packing device 413 has an upper seat 4131, a lower seat 4132, an eccentric shaft 4133, and a packing ring 4134. The upper seat 4131 is fixedly connected at the upper tube 411, the lower seat 4132 is fixedly connected at the lower tube 412 and has a diameter greater than that of the inwardly-shrinking hole 123 of the tail-end portion 12 of the first tube body 10, a head end and a tail end of the eccentric shaft 4133 are pivotally connected to the upper seat 4131 and the lower seat 4132 separately, and the packing ring 4134 is disposed around the eccentric shaft 4133 and is freely rotatable about the eccentric shaft 4133. A top rod structure 4111 (which may be directly implemented by using an end surface of the upper tube 411, or disposed inside the upper tube 411) is disposed at an end, away from the upper seat 4131, of the upper tube 411, and a sheath structure 4121 is fixedly disposed at an end, away from the lower seat 4132, of the lower tube 412. The second tube body 40 is inserted from the opening 112 of the head-end portion 11 of the first tube body 10, the lower tube 412 is exposed from the tail-end portion 12 of the first tube body 10, and the upper tube 411 and the telescopic-rod packing device 413 are limited in an inner space of the first tube body 10 by using the inner edge 122 of the inwardly-shrinking hole 123.

Figure 4:
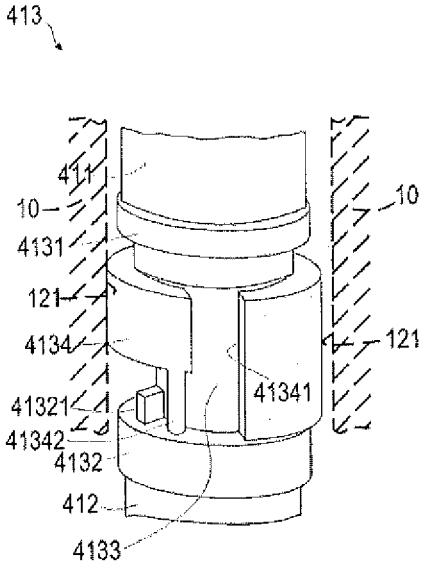
FIG. 4 is an assembly view of a telescopic-rod packing device of an embodiment of an interlocking telescopic rod-type defense spray apparatus according to the present invention.

Please continue to refer to FIG. 3 and FIG. 4, by means of the foregoing structure, when a user wants to lock the first tube body 10 and the second tube body 40 to each other to form an integrated rod body, a central axis of the second tube body 40 may be first used as a rotation axial center, and the lower tube 412 is rotated along a first direction (for example, a positive direction, a clockwise direction), so as to push the packing ring 4134 to radially deviate outward from the eccentric shaft 4133 to protrude from the rod body portion 41, so as to abut a corresponding inner wall surface 121 of the first tube body 10. In contrast, when the user wants to release a locked relationship between relative positions of the first tube body 10 and the second tube body 40, the lower tube 412 may be slightly rotated along a direction (for example, a negative direction, a counterclockwise direction) opposite to the first direction, so that the packing ring 4134 no longer deviates outward from the eccentric shaft 4133 for pushing, so as to release the packing ring 4134 to release the corresponding inner wall surface 121 of the first tube body 10.

Furthermore, a wide space 41331 is formed on a side having the longest distance from a surface of the eccentric shaft 4133 to the inner wall surface 121 of the first tube body 10, and a narrow space 41332 is formed on a side having the shortest distance from the surface of the eccentric shaft 4133 to the inner wall surface 121 of the first tube body 10. The lower seat 4132 of the telescopic-rod packing device 413 has a fingering board 41321 that rotates synchronously with rotation of the lower tube 412, the packing ring 4134 is made of a material having a large frictional coefficient, and a ring surface of the packing ring 4134 comes into contact with the inner wall surface 121 of the first tube body 10, so that when the eccentric shaft 4133 is rotated, the packing ring 4134 does not rotate accordingly, so as to achieve relative rotation. The packing ring 4134 has an eccentric hole 41343, a gap 41341 is provided between an outer diameter of the packing ring 4134 and the eccentric hole 41343, and by using the gap 41341, the eccentric hole 41343 may be disposed around the eccentric shaft 4133, so that a thick wall 41344 and a thin wall 41345 are formed from the eccentric hole 41343 to the outer diameter of the packing ring 4134, and a locking and stopping structure 41342 is formed at an end of a rotation path, corresponding to the fingering board 41321, of the packing ring 4134. When the lower tube 412 is rotated, the eccentric shaft 4133 and the fingering board 41321 rotate synchronously, so that the thick wall 41344 of the packing ring 4134 is clamped in the narrow space 41332 and an outer side of the thick wall 41344 of the packing ring 4134 protrudes outward to tightly abut the inner wall surface 121 of the first tube body 10 (in this case, the fingering board 41321 pushes the locking and stopping structure 41342), or the lower tube 412 is rotated in an opposite direction to accordingly enable the thick wall 41344 of the packing ring 4134 to be clamped in the wide space 41331 and enable the outer side of the thick wall 41344 of the packing ring 4134 to be retracted inwardly to release the inner wall surface 121 of the first tube body 10 (in this case, the fingering board 41321 leaves to release the locking and stopping structure 41342). After the telescopic-rod packing device 413 releases the inner wall surface 121 of a tube wall of the first tube body 10, the sheath structure 4121 of the second tube body 40 is held and pushed toward the first tube body 10, so that the top rod structure 4111 of the second tube body 40 is enabled to push the can body bottom portion A5 of the irritant gas can A, to press the press-ring portion A2 to spray the contents A3.

It should be noted that, in an embodiment, for example, the top rod structure 4111 in the foregoing embodiment may be directly implemented by using an end surface 4112 at an end, away from the upper seat 4131, of the upper tube 411, and subsequently the end surface 4112 of the second tube body 40 may directly push a concave position of the can body bottom portion A5 of the irritant gas can A.

In still another embodiment, a hole 41121 is provided on the end surface 4112 at an end, away from the upper seat 4131, of the upper tube 411 in the foregoing embodiment, and the top rod structure 4111 of the upper tube 411 may be disposed inside the upper tube 411 and sequentially includes a convex-type element 41111 having a top rod. 411110, a compression spring 41112, and a fixing element 41113. The fixing element 41113 is fixedly screwed on an inner wall of the upper tube 411 by using a screw 41114 to support the compression spring 41112, and the convex-type element 41111 is pushed upward by the compression spring 41112, so that the top rod 411110 protrudes from the hole 41121. A shortened travel length after the compression spring 41112 is pressed is less than a length by which the top rod 411110 protrudes from the hole 41121. The compression spring 41112 can reduce vertical shaking of the irritant gas can A in the receiving chamber 111. In other words, after position locking between the first tube body 10 and the second tube body 40 is released, when the sheath structure 4121 is held and pushed toward the first tube body 10, after the top rod 411110 of the convex-type element 41111 reaches the can body bottom portion A5 of the irritant gas can A, the convex-type element 41111 temporarily stops pushing. Instead, the compression spring 41112 absorbs a pushing force from the sheath structure 4121. After the compression spring 41112 is shortened to a limit, a part of the top rod 411110 still protrudes from the end surface 4112. At this time, the convex-type element 41111 may continue to be pushed to enable the top rod 411110 (or in another embodiment, the end surface 4112 of the second tube body 40 directly) to push the concave position of the can body bottom portion A5 of the irritant gas can A, so that the top rod 411110 and the can body bottom portion A5 are tightly joined, so as to transfer a maximum pushing force. The pressing ring portion A2 is subject to a pushing force from behind, and the recessed seat 21 in front blocks and limits the can body top portion A4. Therefore, the compression elastic piece 30 is shortened to a limit, so as to spray the contents A3 from the output tube A1.

In addition, to keep a spray path of the irritant gas can A unobstructed, when a defense spray function is not used, an end plug 22 inserted in the through hole 211 is further included on a surface, opposite the receiving chamber 111, of the cap 20; however, before the defense spray function is used, the end plug 22 must be removed.

Figure 5:
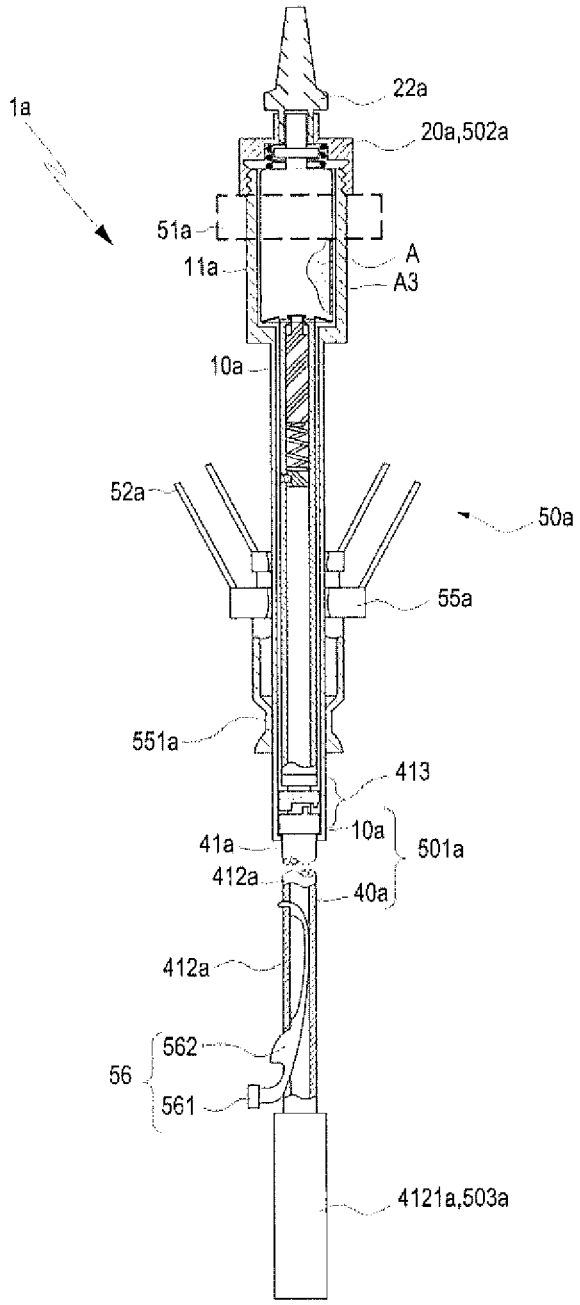
FIG. 5 is a schematic sectional view of an embodiment of an umbrella-type defense spray apparatus of an interlocking telescopic rod-type defense spray apparatus according to the present invention.
Figure 6:
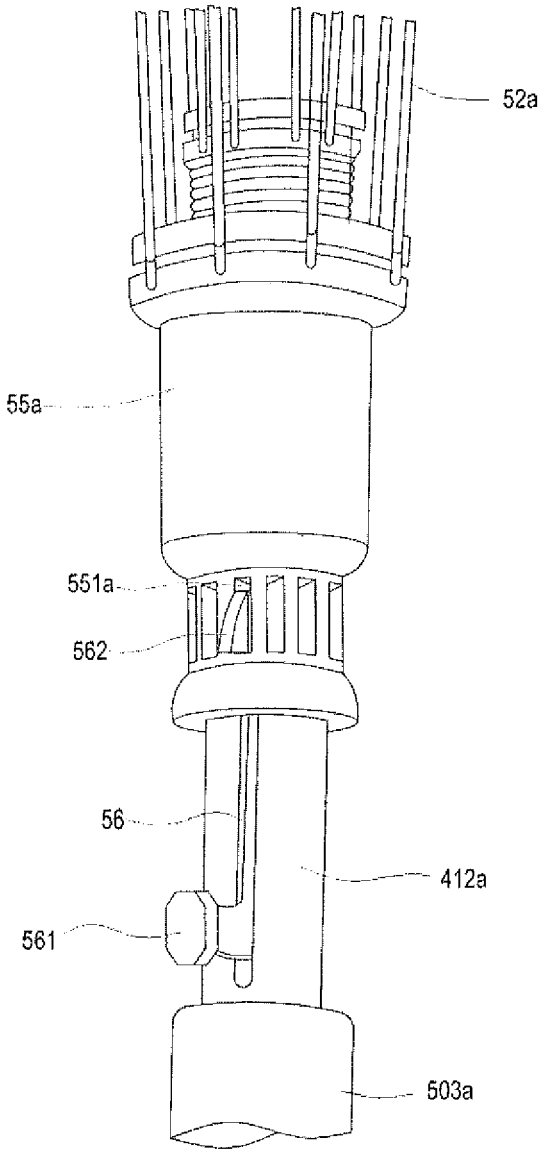
FIG. 6 is a schematic perspective view of a multi-fastening-hole runner fastened to a lengthened lower spring in the embodiment in FIG. 5.
Figure 7:
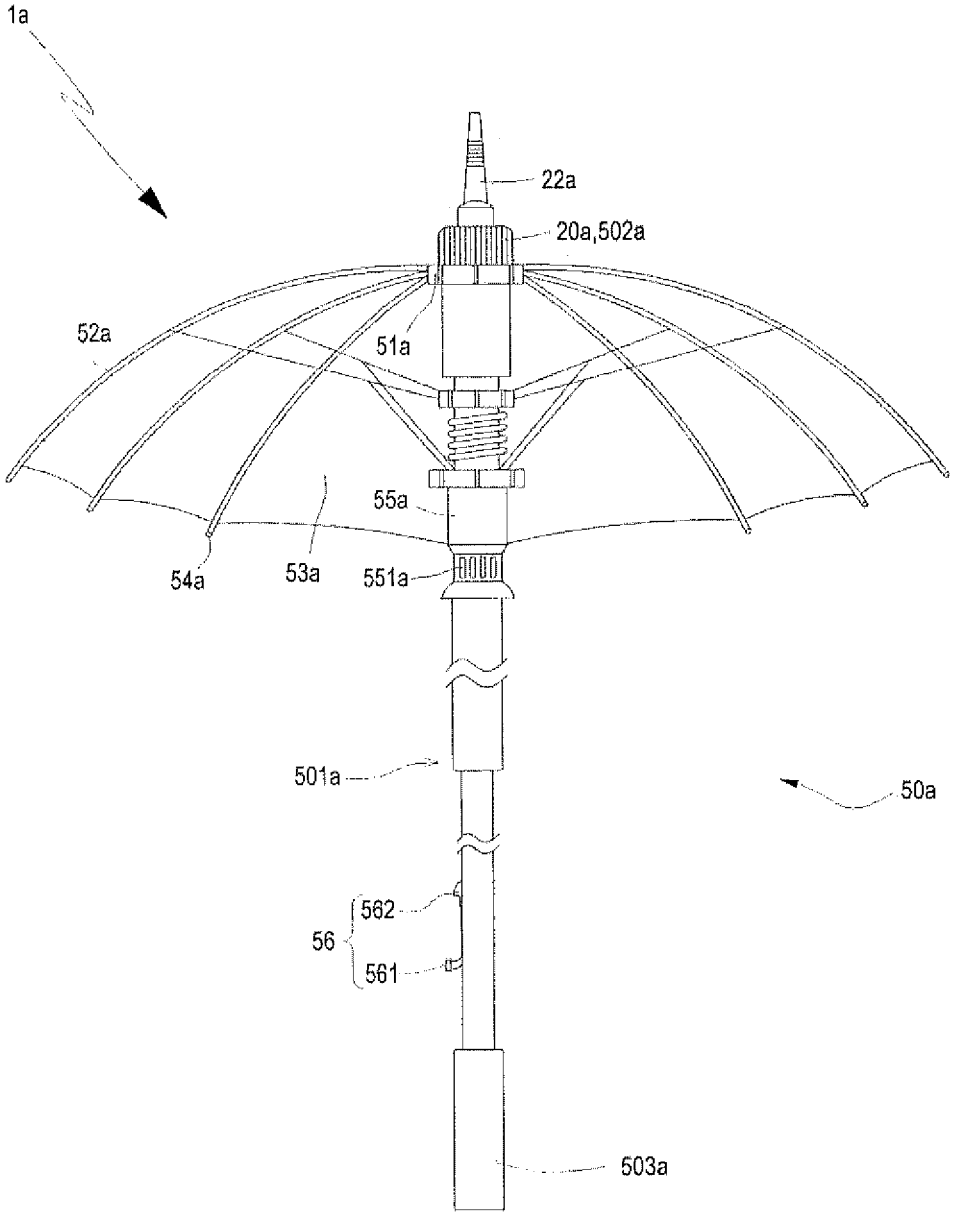
FIG. 7 is a schematic perspective view of an umbrella in an extended state in the embodiment in FIG. 5.

Please continue to refer to FIG. 5, FIG. 6, and FIG. 7. An interlocking telescopic rod-type defense spray apparatus 1*a* in this embodiment has members such as a first tube body 10*a*, a head-end portion 11*a*, a cap 20*a*, a second tube body 40*a*, a rod body portion 41*a*, and a sheath structure 4121*a* in the foregoing corresponding embodiment of two sectioned rods, and further includes an umbrella component 50*a* to form an umbrella-type defense spray apparatus. The umbrella component 50*a* includes: a central rod 501*a*, an umbrella cap 502*a*, an umbrella handle 503*a*, a notch 51*a*, a rib 52*a*, a cloth 53*a*, multiple tips 54*a*, a runner 55*a*, and a lengthened lower spring 56 for fastening or unfastening the runner 55*a*. A rod body that includes the first tube body 10*a* and the second tube body 40*a* forms the central rod 501*a* of the umbrella component 50*a*, the cap 20*a* forms the umbrella cap 502*a* of the umbrella component 50*a*, the sheath structure 4121*a* forms the umbrella handle 503*a* of the umbrella component 50*a*, the notch 51*a* is sleeved over the head-end portion 11*a* of the first tube body 10*a*, the lengthened lower spring 56 is disposed at a lower tube 412*a* of the second tube body 40*a*, the runner 55*a* is disposed between the notch 51*a* and the lengthened lower spring 56 and is axially slideable on peripheral surfaces of the first tube body 10*a* and the lower tube 412*a* (that is, the central rod 501*a*) of the second tube body 40*a*, the rib 52*a* is connected between the notch 51*a* and the runner 55*a*, and the cloth 53*a* and the tips 54*a* are disposed on the rib 52*a*. The cloth 53*a* is opened when the runner 55*a* moves to a side of the notch 51*a*, and the cloth 53*a* is folded when the runner 55*a* moves to the lengthened lower spring 56. For a manner in which the lengthened lower spring 56 is fastened to the runner 55*a*, multiple fastening holes 551*a* that can be fastened to the lengthened lower spring 56 are provided around the runner 55*a* at a periphery corresponding to the rod body portion 41*a*. In this way, each time when the lower tube 412*a* is rotated to a different angle from the first tube body 10*a* because the lower tube 412*a* is locked to the first tube body 10*a* by using the telescopic-rod packing device 413, the lengthened lower spring 56 that turns in a direction accordingly may still be fastened to one of the multiple fastening holes 551*a* corresponding to the runner 55*a*. In addition, as shown in FIG. 6, to make it still possible to perform actions of releasing locking between the first tube body 10*a* and the second tube body 40*a* and pushing the second tube body 40*a* forward when the lengthened lower spring 56 and the runner 55*a* are fastened, a length between a press button 561 of the lengthened lower spring 56 and a hook plate 562 of the lengthened lower spring 56 needs to be increased. A distance between the press button 561 and the hook plate 562 of the lengthened lower spring 56 is greater than or equal to a pushing distance by which the second tube body 40*a* pushes the first tube body 10*a* to spray contents A3 of the irritant gas can A, so that after the user presses the press button 561, the lower tube 412*a* is rotated for unlocking and pushed forward to perform a spray action.

Figure 8:
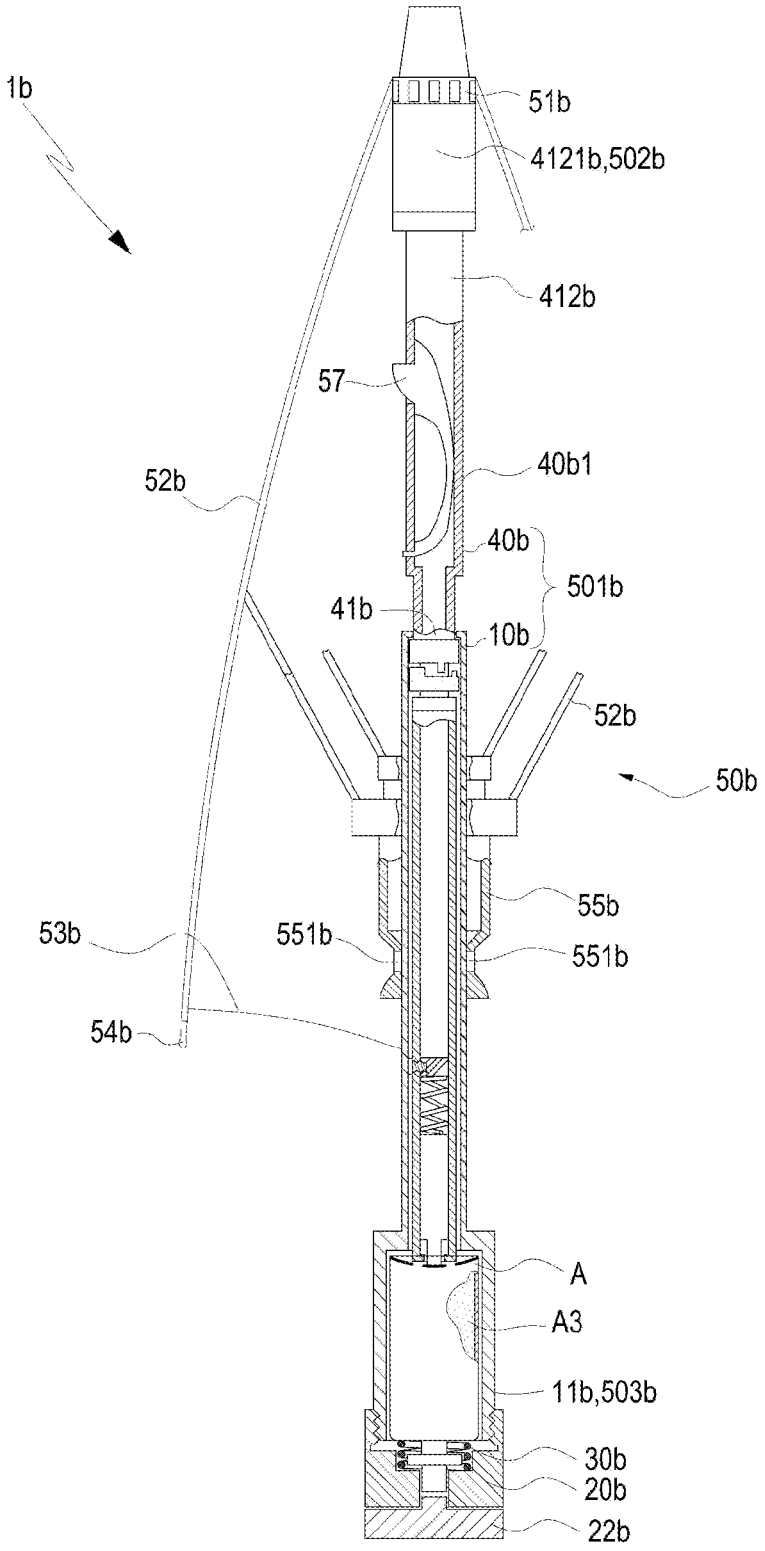
FIG. 8 is a schematic sectional view of an embodiment of another umbrella-type defense spray apparatus of an interlocking telescopic rod-type defense spray apparatus according to the present invention.

Please refer to FIG. 8. An interlocking telescopic rod-type defense spray apparatus 1*b* in this embodiment includes members such as a first tube body 10*b*, a head-end portion 11*b*, a cap 20*b*, a compression elastic piece 30*b*, a second tube body 40*b*, a rod body portion 41*b*, and a sheath structure 4121*b* in the foregoing corresponding embodiment of two sectioned rods, and further includes an umbrella component 50*b* to form an umbrella-type defense spray apparatus. The umbrella component 50*b* includes: a central rod 501*b*, an umbrella cap 502*b*, an umbrella handle 503*b*, a notch 51*b*, a rib 52*b*, a cloth 53*b*, multiple tips 54*b*, a runner 55*b*, and an upper spring 57 for fastening or unfastening the runner 55*b*. A rod body that includes the first tube body 10*b* and the second tube body 40*b* is turned around (that is, a lower tube of a second rod body is in front, and a first rod body is behind) to form the central rod 501*b* of the umbrella component 50*b*, the sheath structure 4121*b* forms the umbrella cap 502*b* of the umbrella component 50*b*, the head-end portion 11*b* of the first tube body 10*b* forms the umbrella handle 503*b* of the umbrella component 50*b*, the notch 51*b* is disposed on an adjacent side of the sheath structure 4121*b* of the second tube body 40*b*, and the runner 55*b* is disposed at a periphery of the first tube body 10*b* and is slideable on a periphery (the central rod 501*b*) of a lower tube 412*b* of the second tube body 40*b*. However, a diameter of a tube body, at which the upper spring 57 is disposed, on an upper segment of the second tube body 40*b* should be greater than a diameter of a tube path of a lower segment of the second tube body 40*b* (however, for a length of a relatively long tube path of the upper segment of the second tube body 40*b*, a length of an original tube diameter needed for pushing between the first tube body 10*b* and the irritant gas can A to spray the contents A3 still needs to be reserved) to fit the runner 55*b*—wherein the upper segment of the second tube body 40*b* is an enlarged tube body 40*b*1. The upper spring 57 is disposed at a relatively long tube path of the upper segment of the second tube body 40*b*, the rib 52*b* is connected between the notch 51*b* and the runner 55*b* and, and the cloth 53*b* and the tips 54*b* are disposed on the rib 52*b*. When the runner 55*b* slides to the upper spring 57, the upper spring 57 may be hooked to multiple fastening holes 551*b* provided around the runner 55*b*, so as to open the cloth 53*b*, and the cloth 53*b* is folded when the runner 55*b* moves downward to the first tube body 10*b*. In such a form, after locking between the first tube body 10*b* and the second tube body 40*b* is released, the first tube body 10*b* and the lower tube 412*b* may be separately held and pushed to each other, so that the contents A3 of the irritant gas can A can be sprayed from an end surface of the umbrella handle 503*b* (that is, the cap 20*b* of the first tube body 10*b*) (similarly, an end plug 22*b* for dust-proof and water-proof purposes needs to be pulled off first).

Figure 9:
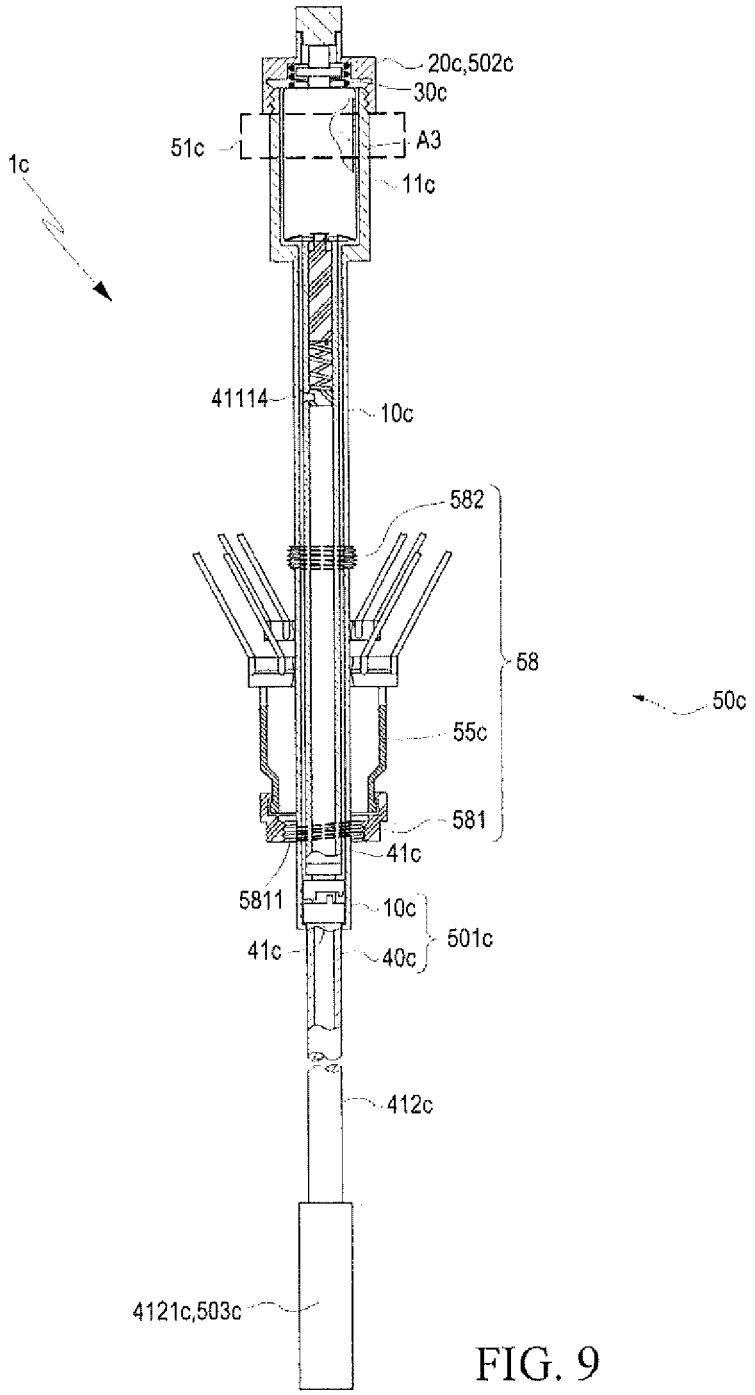
FIG. 9 is a schematic sectional view of an embodiment of still another umbrella-type defense spray apparatus of an interlocking telescopic rod-type defense spray apparatus according to the present invention.
Figure 10:
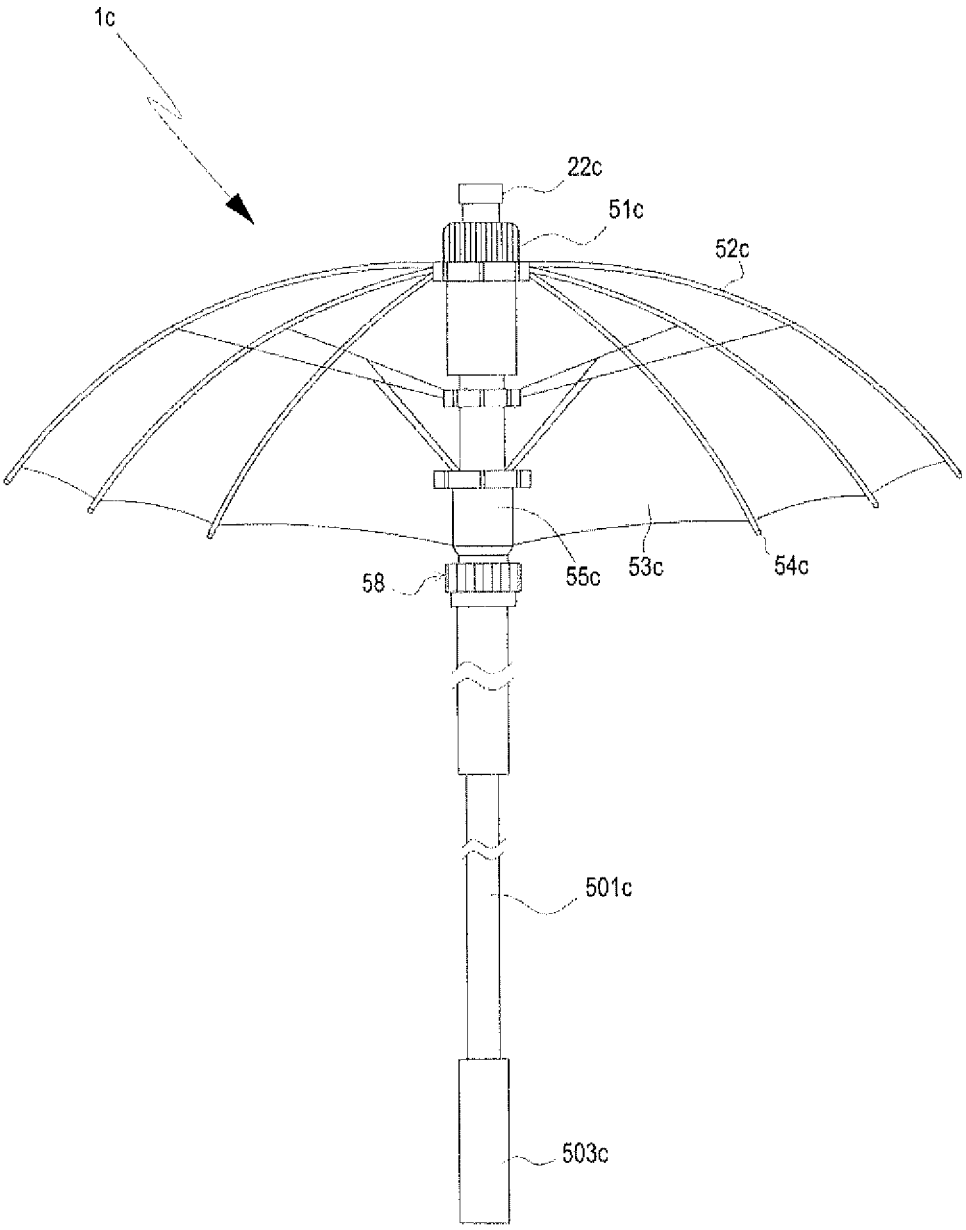
FIG. 10 is a schematic perspective view of an umbrella in an extended state in the embodiment in FIG. 9.

Please refer to FIG. 9 and FIG. 10. An interlocking telescopic rod-type defense spray apparatus 1*c* in this embodiment includes members such as a first tube body 10*c*, a head-end portion 11*c*, a cap 20*c*, a compression elastic piece 30*c*, a second tube body 40*c*, a rod body portion 41*c*, and a sheath structure 4121*c* in the foregoing corresponding embodiment of two sectioned rods, and further includes an umbrella component 50*c* to form an umbrella-type defense spray apparatus. The umbrella component 50*c* includes: a central rod 501*c*, an umbrella cap 502*c*, an umbrella handle 503*c*, a notch 51*c*, a rib 52*c*, a cloth 53*c*, multiple tips 54*c*, a runner 55*c*, and a runner locking structure 58 for locking or unlocking the runner 55*c*. A rod body that includes the first tube body 10*c* and the second tube body 40*c* forms the central rod 501*c* of the umbrella component 50*c*, the cap 20*c* forms the umbrella cap 502*c* of the umbrella component 50*c*, the sheath structure 4421*c* forms the umbrella handle 503*c* of the umbrella component 50*c*, the notch 51*c* is disposed at the head-end portion 11*c* of the first tube body 10*c*, and the runner 55*c* is disposed at a periphery of the first tube body 10*c* and a lower tube 412*c* on a side, facing the sheath structure 4121*c*, of the notch 51*c*, and may axially slide on peripheral surfaces of the first tube body 10*c* and the lower tube 412*c* of the second tube body 40*c*. The runner locking structure 58 includes a spiral sheath-lock element 581 sheathing the runner 55*c* and is freely rotatable (and an inner thread 5811 is disposed on an inner surface of the spiral sheath-lock element 581), and an external thread 582 that is disposed on a surface of the first tube body 10*c* and corresponds to the inner thread 5811 of the spiral sheath-lock element 581. The rib 52*c* is connected between the notch 51*c* and the runner 55*c*, and the cloth 53*c* and the tips 54*c* are disposed on the rib 52*c*. The cloth 53*c* is opened when the runner 55*c* moves to the surface of the first tube body 10*c* and is locked at the external thread 582, and the cloth 53*c* is folded when the runner 55*c* moves to a side, facing the sheath structure 4121*c*, of the external thread 582.

Figure 11:
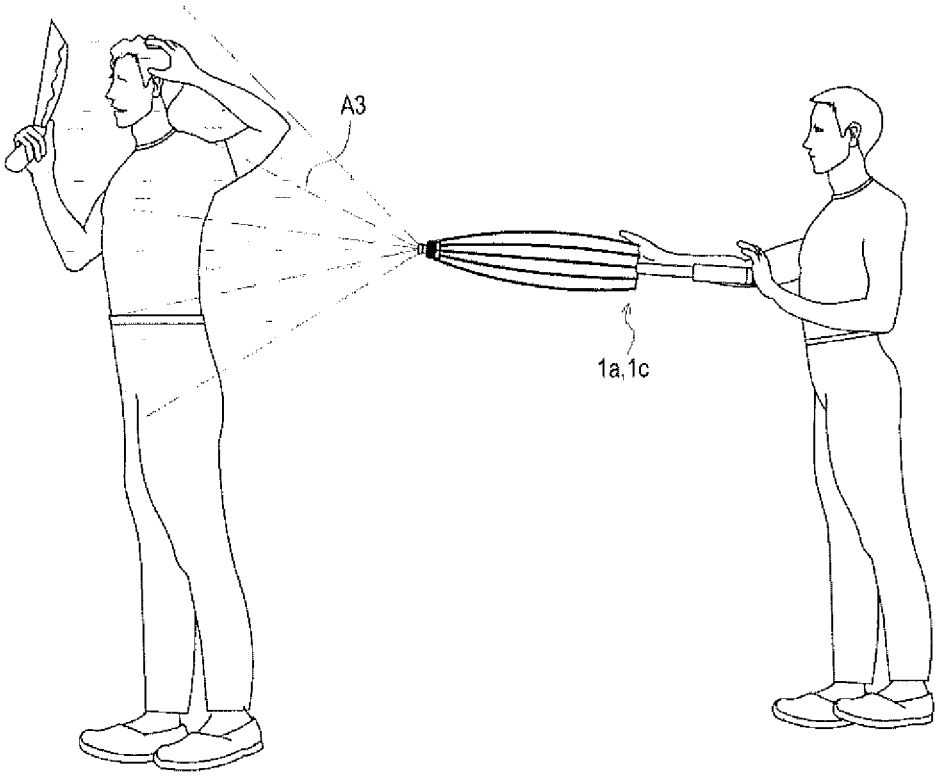
FIG. 11 is a schematic view of using a defense spray function of an embodiment of an umbrella-type defense spray apparatus of an interlocking telescopic rod-type defense spray apparatus according to the present invention.

As shown in FIG. 11, in the embodiments of the foregoing umbrella-type defense spray apparatus of the present invention, when the first tube body (10*a*, 10*b*, 10*c*) and the second tube body (40*a*, 40*b*, 40*c*) are locked to each other, the defense spray apparatus has a function for protection against sunlight or rain of a common umbrella (as shown in FIG. 7 and FIG. 10). However, when locking between the first tube body (10*a*, 10*b*, 10*c*) and the second tube body (40*a*, 40*b*, 40*c*) is released, the contents A3 of the irritant gas can A can be sprayed from all end surface of the umbrella cap (502*a*, 502*c*) or the umbrella handle (503*b*).

Figure 12:
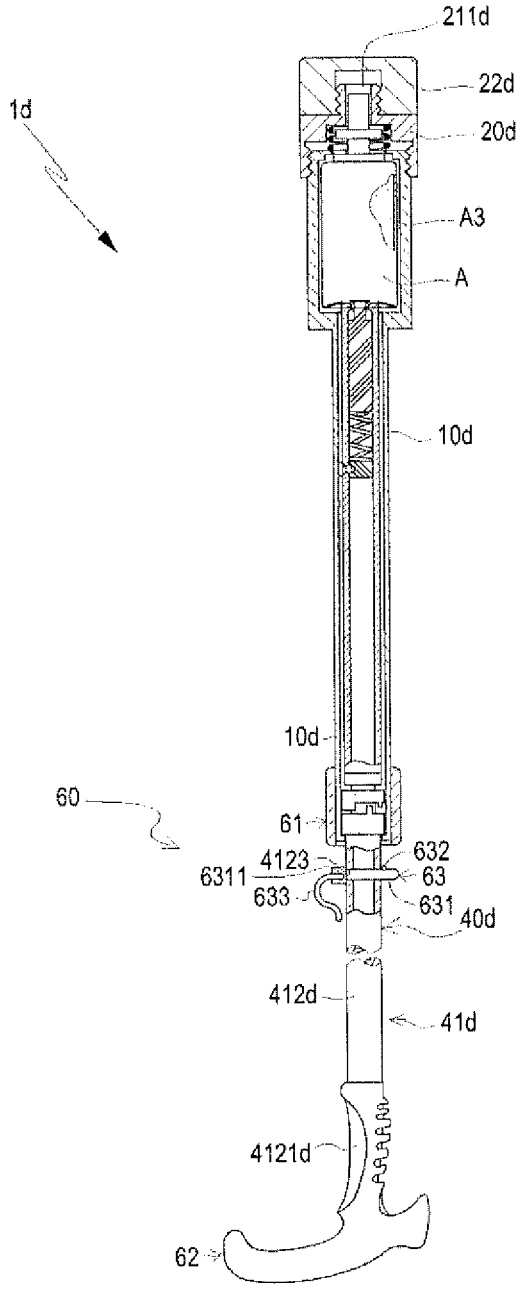
FIG. 12 is a schematic sectional view of an embodiment of a cane-type defense spray apparatus of an interlocking telescopic rod-type defense spray apparatus according to the present invention.
Figure 13:
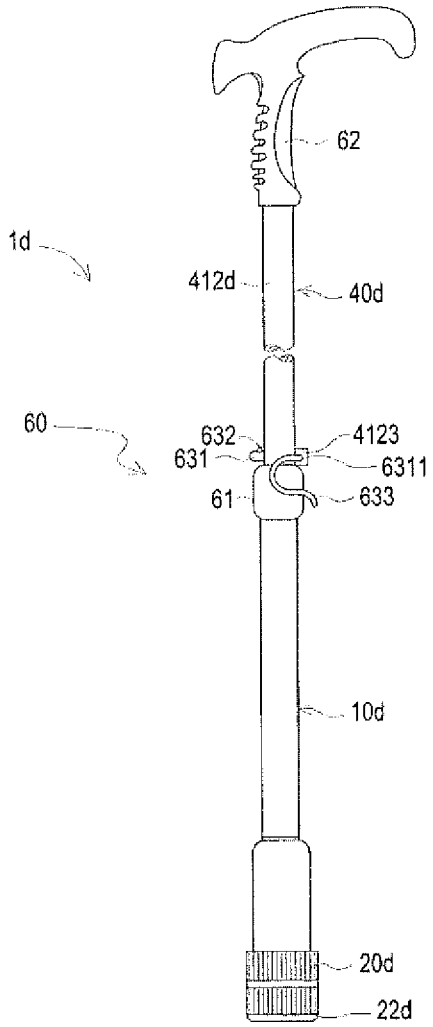
FIG. 13 is a perspective view of the embodiment in FIG. 12.

Please refer to FIG. 12 and FIG. 13. An interlocking telescopic rod-type defense spray apparatus 1*d* of this embodiment includes members such as a first tube body 10*d*, a cap 20*d*, a through hole 211*d*, an end plug 22*d*, a second tube body 40*d*, a lower tube 412*d*, and a sheath structure 4121*d* in the foregoing corresponding embodiment of two sectioned rods, and further includes a cane component 60. The cane component 60 includes a joint sheath 61 and a cane handle 62. The joint sheath 61 wraps a surface in a joining area between the first tube body 10*d* and the lower tube 412*d* of the second tube body 40*d* and is used to reinforce an anti-bending capability of a position where the first tube body 10*d* and the lower tube 412*d* are joined, so as to improve a pressure bearing capability of the first tube body 10*d* and the lower tube 412*d* being combined into a rod body as a cane. The sheath structure 4121*d* of the lower tube 412*d* forms the cane handle 62 for the user to hold.

Figure 14:
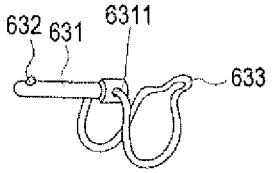
FIG. 14 shows a positioning insertion pin component of a cane in FIG. 13.
Figure 15:
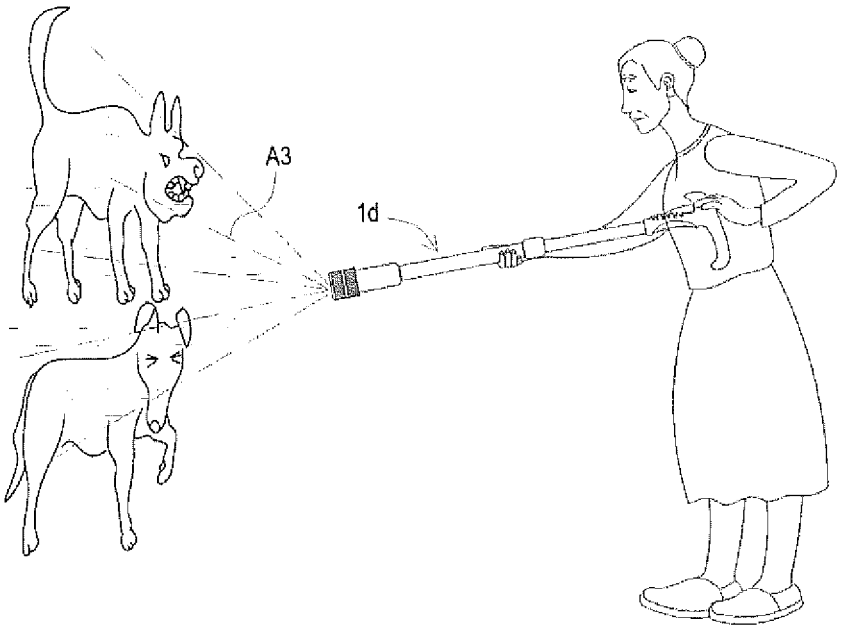
FIG. 15 is a schematic view of using a defense spray function of a cane-type defense spray apparatus of an interlocking telescopic rod-type defense spray apparatus according to the present invention.

Furthermore, in an embodiment, on an end surface, corresponding to the joint sheath 61, of the lower tube 412*d*, at least one pinhole 4123 is disposed or multiple pinholes 4123 are disposed at intervals along an axial direction, and a positioning insertion pin component 63 is further included. The positioning insertion pin component 63 includes an insertion pin 631 removably inserted in a radial direction in the pinhole 4123 on a tube body of the lower tube 412*d*, and stopped at the end surface of the joint sheath 61, so that it may be avoided that the lower tube 412*d* is subject to a force of the user and is pushed down to sink in an inner diameter of the first tube body 10*d*, and an anti-bending capability of a combined rod body of the first tube body 10*d* and the lower tube 412*d* may be further improved. A radially protruding spring ball 632 is provided at a tail end of the insertion pin 631, and a freely rotatable U-type adjustable clamp ring 633 is pivotally disposed in a pivotal hole 6311 at a head end of the insertion pin 631 (as shown in FIG. 12, FIG. 13, and FIG. 14). The U-type adjustable clamp ring 633 may be held on an outer diameter of the joint sheath 61. By means of an effect of the spring ball 632 or the U-type adjustable clamp ring 633 or an effect of combining the foregoing two, the insertion pin 631 may be prevented from accidentally falling off from the lower tube 412*d*, so that safety in use as a cane can be improved. The U-type adjustable clamp ring 633 may also release the outer diameter of the joint sheath 61 from being held, and is used to be held to pull out the insertion pin 631. Certainly, a tail-end part of the U-type adjustable clamp ring 633 may be designed to slightly bend upward to be suspended from the joint sheath 61, and a function of the tail-end part of the U-type adjustable clamp ring 633 is that the insertion pin 631 can be rapidly pulled out. Similarly, as shown in FIG. 15, when locking between the first tube body 10*d* and the second tube body 40*d* is released, the contents A3 of the irritant gas can A can be sprayed from the through hole 211*d* on an end surface of the cap 20*d* (the end plug 22*d* is removed in advance).

Figure 16:
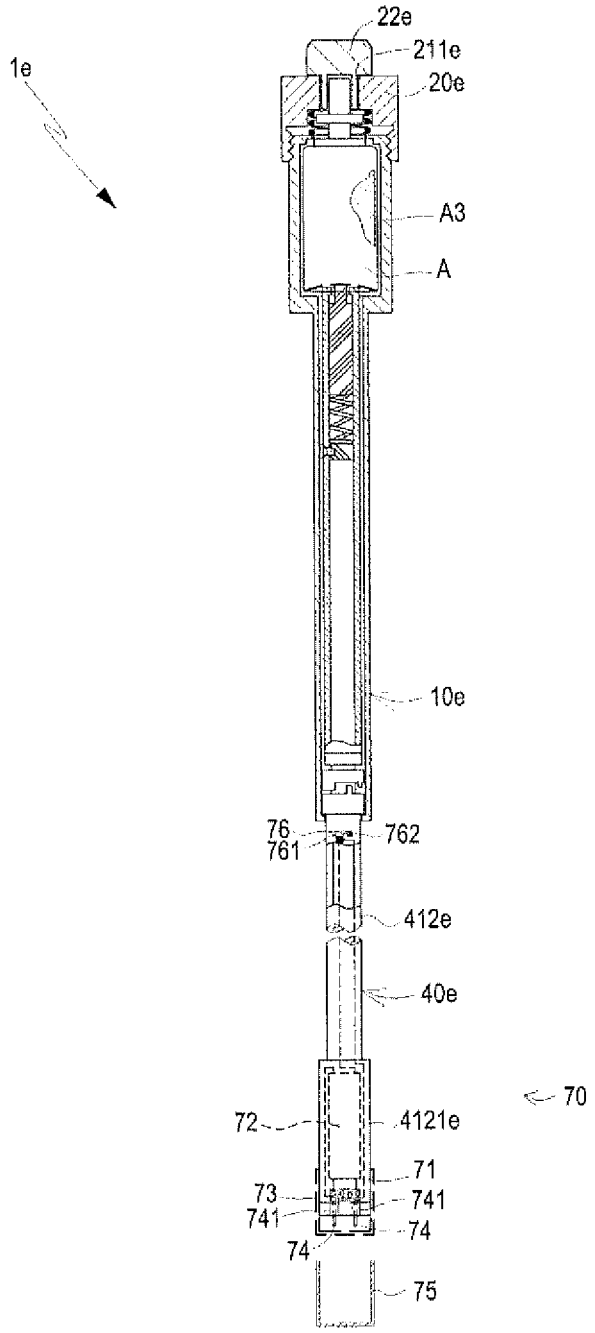
FIG. 16 is a schematic sectional view of an embodiment of an electric shock-baton-type defense spray apparatus of an interlocking telescopic rod-type defense spray apparatus according to the present invention.
Figure 18:
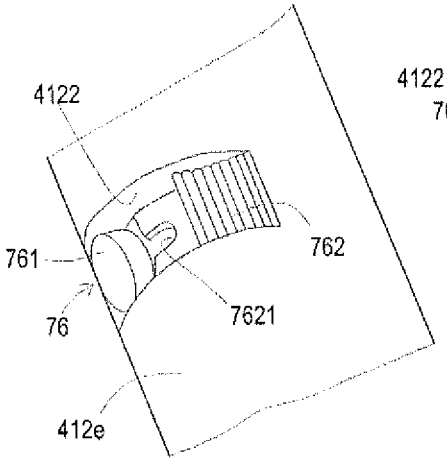
FIG. 18 is an enlarged partial schematic view of an electric shock switch structure in FIG. 17.
Figure 17:
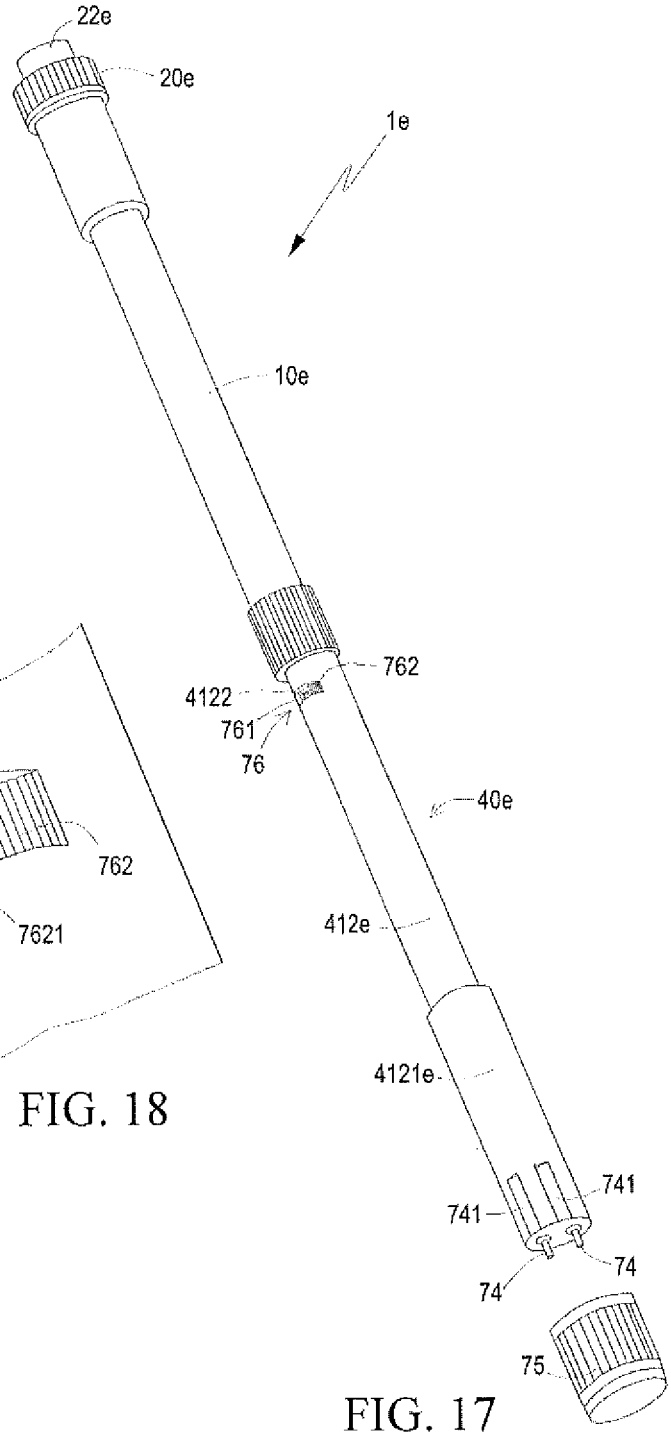
FIG. 17 is a perspective view of the embodiment in FIG. 16.

Please refer to FIG. 16, FIG. 17, and FIG. 18. An interlocking telescopic rod-type defense spray apparatus 1*e* in this embodiment includes members such as a first tube body 10*e*, a cap 20*e*, a through hole 211*e*, a second tube body 40*e*, a lower tube 412*e*, and a sheath structure 4121*e* in the foregoing corresponding embodiment of two sectioned rods, and further includes an electrode rod component 70. The electrode rod component 70 includes: a battery holder 71, disposed inside the sheath structure 4121*e*; a battery 72, placed in the battery holder 71; a boost circuit 73, electrically connected to the battery 72; a pair of electrode needles 74, disposed on an end surface at an end of the sheath structure 4121*e*, multiple electrode plates 741 being disposed on a surface of the sheath structure 4121*e*, and the pair of electrode needles 74 being electrically connected to the boost circuit 73; a protection lid 75, covering the end surface of the sheath structure 4121*e* to cover the pair of electrode needles 74 and the electrode plates 741; and a circuit switch 76, disposed in a groove 4122 below a tube body surface of the lower tube 412*e*, so as to prevent a blockage from appearing on a push path between the first tube body 10*e* and the second tube body 40*e*, and electrically connected to the battery 72, so as to enable the electrode needles 74 to generate an electric shock by closing the circuit switch 76.

Moreover, as shown in FIG. 17 and FIG. 18, to prevent the user from accidentally touching the foregoing the circuit switch 76 to cause the electrode needles 74 and the electrode plates 741 to generate an electric shock, the circuit switch 76 may include a button locking structure 762, so that in only an unlocked state of the button locking structure 762, the circuit switch 76 can be used to energize a power path by using a press-down switch button 761. In practice, the groove 4122 for receiving the circuit switch 76 is a groove hole perpendicular to a central axis direction of the lower tube 412*e*. The circuit switch 76 includes a press-down switch button 761 and a button locking structure 762. The button locking structure 762 can move along the groove 4122, and a fork portion 7621 is provided at an end of the button locking structure 762. By means of movement of the button locking structure 762, the fork portion 7621 is kept against a push-down path of the press-down switch button 761 (to limit energization using the circuit switch 76) or removed from the push-down path (to release a limit on energization using the circuit switch 76).

Figure 19:
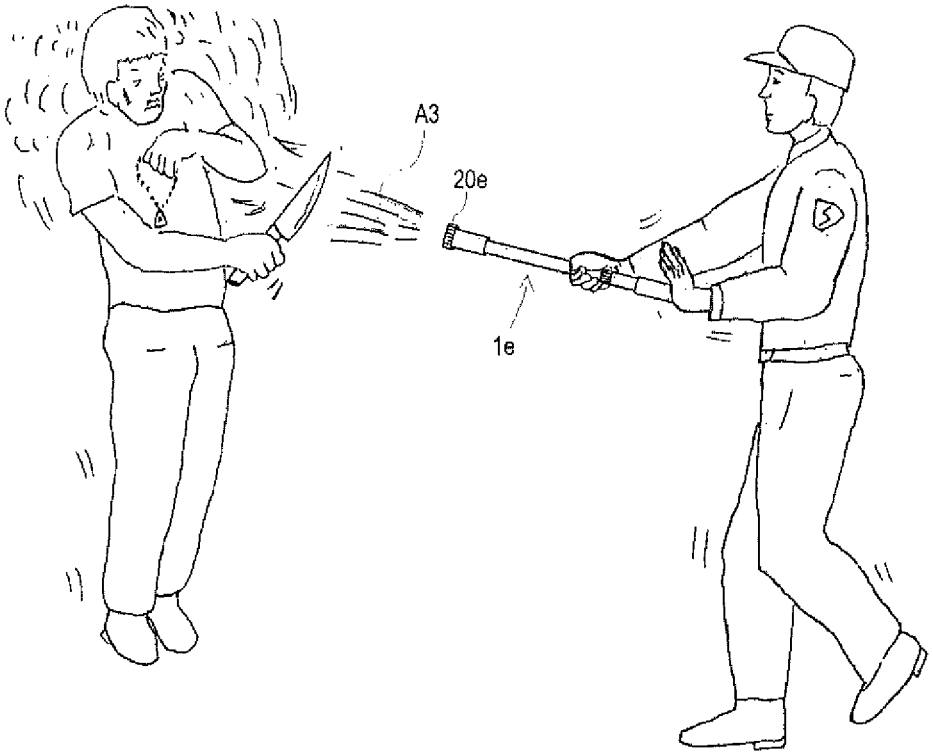
FIG. 19 is a schematic view of using a defense spray function of an electric shock-baton-type defense spray apparatus according to the present invention.
Figure 20:
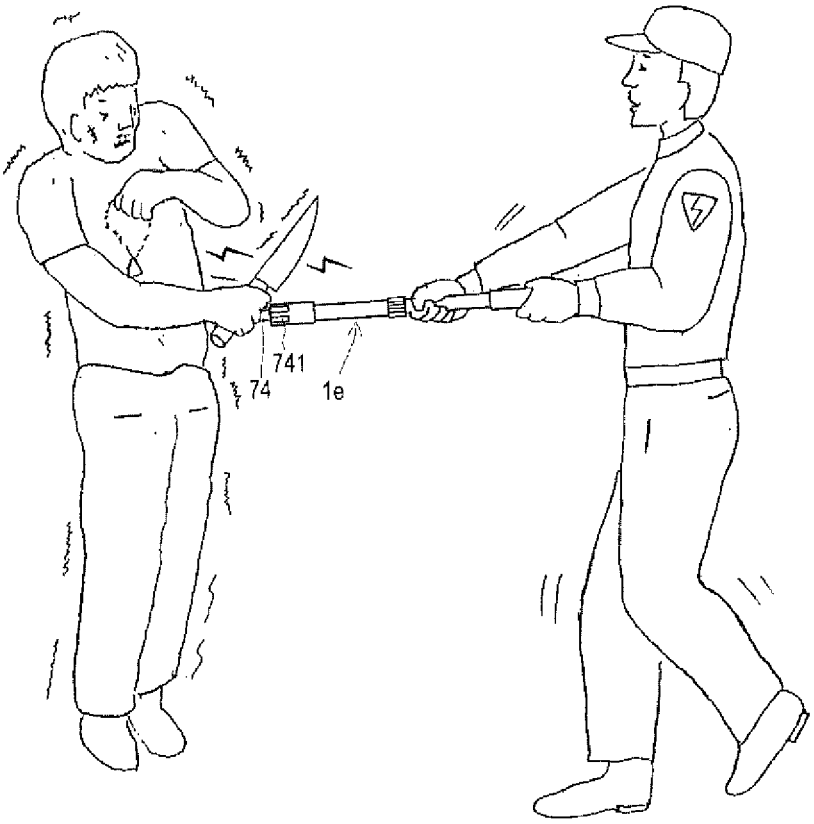
FIG. 20 is a schematic view of using an electric shock baton function of an electric shock-baton-type defense spray apparatus according to the present invention.

Please refer to FIG. 19 and FIG. 20 again. In an actual use example of the foregoing electric-shock-baton-type defense spray apparatus 1*e*, an end plug 22*e* may be removed first, and locking between the first tube body 10*e* and the second tube body 40*e* is then released. By means of a defense spray function of the defense spray apparatus 1*e*, the contents A3 of the irritant gas can A are sprayed from the through hole 211*e* on an end surface of the cap 20*e*, so that defense spray is sprayed at a villain (as shown in FIG. 19). Next, the first tube body 10*e* and the second tube body 40*e* are then locked, and the circuit switch 76 is closed to give the villain an electric shock by using the electrode needles 74 and the electrode plates 741 (as shown in FIG. 20).

Figure 21:
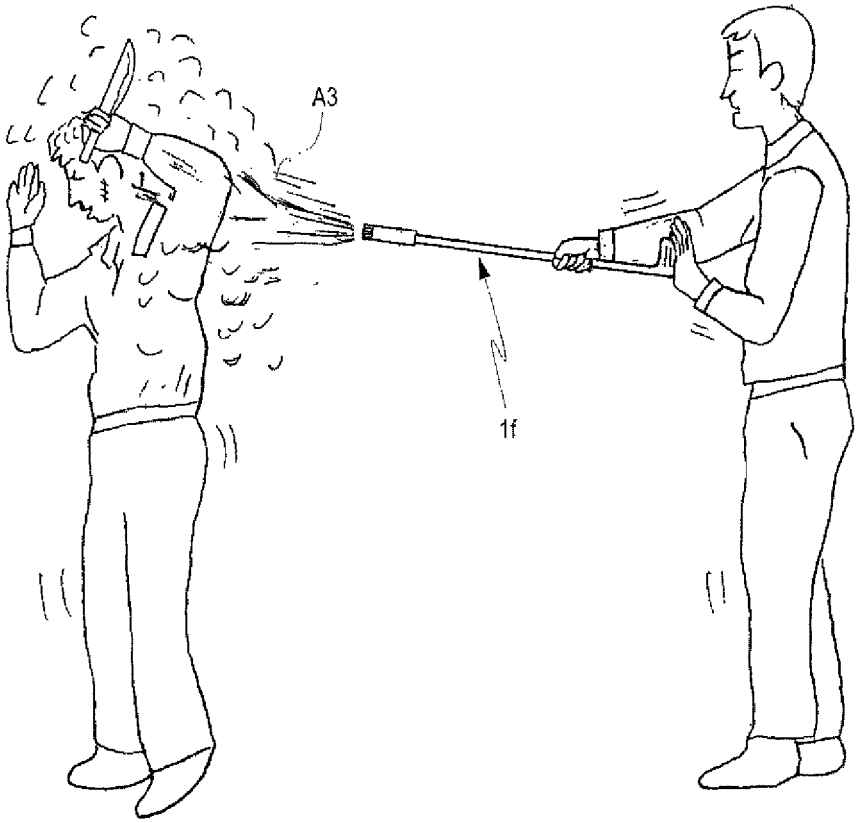
FIG. 21 is a schematic view of using a defense spray function of an embodiment of a golf-club-type defense spray apparatus of an interlocking telescopic rod-type defense spray apparatus according to the present invention.

It should be noted that, by means of the present invention, in addition to the foregoing that a defense spray apparatus is integrated with a function of a staff, an umbrella, a cane, a flashlight or an electrode rod, an upper tube may be further shortened to reduce a volume to achieve higher portability. Certainly, the present invention may also be disguised as a golf-club defense spray apparatus 1*f*. A club handle end is used as a first tube body 10*f*, and a ball head end used as a second tube body 40*f* is pressed to spray defense spray from the club handle end, as shown in FIG. 21.

In conclusion, the foregoing implementation manners or embodiments of the adopted technical means of the present invention are not used to limit the patent scope of the present invention. That is, all equivalent changes and modifications that conform to the meaning of the claims of the present invention or that are made according to the claims of the present invention shall fall within the patent scope of the present invention.

What is claimed is:

1. An interlocking telescopic rod defense spray apparatus, used to spray contents of an irritant gas can disposed inside telescopic rods after locking between the telescopic rods is unlocked, a protruding output tube being provided at a top portion of the irritant gas can, a press-ring portion being provided at a periphery of the output tube and being subject to an external force to spray the contents from the output tube, the defense spray apparatus comprising:

a first tube body, having a head-end portion and a tail-end portion, a receiving chamber having a diameter being provided in an intra-tube space of the head-end portion, an opening being provided on an end surface of the receiving chamber and being used for the irritant gas can to be held in the receiving chamber, and an inner edge being provided at an opening on an end surface of the tail-end portion, to form an inwardly-shrinking hole;

a cap, tightly covering the opening of the receiving chamber, a recessed seat being provided at a center, facing the receiving chamber, of the cap, a through hole being provided at a center of the recessed seat, the press-ring portion of the irritant gas can corresponding to the recessed seat, and the output tube being aligned with the through hole;

a compression elastic piece, disposed and kept between the recessed seat and a can body top portion of the irritant gas can; and a second tube body, having a rod body portion, the rod body portion comprising an upper tube, a lower tube, and a telescopic-rod packing device connecting the upper tube and the lower tube, the second tube body being inserted from the head-end portion of the first tube body, so that the lower tube is exposed from the tail-end portion of the first tube body, and the upper tube and the telescopic-rod packing device are limited inside the first tube body by the inner edge of the inwardly-shrinking hole, the telescopic-rod packing device having an upper seat fixedly connected to the upper tube, a lower seat fixedly connected to the lower tube and having a diameter greater than that of the inwardly-shrinking hole, an eccentric shaft having two ends separately fixedly connected to the upper seat and the lower seat, and a packing ring disposed around the eccentric shaft and contacting an inner wall of the first tube body, the packing ring having an eccentric hole corresponding to the eccentric shaft, the eccentric hole having a gap, the eccentric hole being disposed around the eccentric shaft by using the gap, a fingering board that rotates synchronously with rotation of the lower tube being provided on the lower seat of the telescopic-rod packing device, a locking and stopping structure being formed on a rotation path, corresponding to the fingering board, of the packing ring, so that the eccentric shaft and the fingering board rotate synchronously to enable the eccentric packing ring to radially deviate outward, and at the same time to push the locking and stopping structure by using the fingering board, so that the packing deviating outward is locked on the inner wall of the first tube body with a single point, or the lower tube is rotated reversely to enable the fingering board to release a pushing force of pushing the fingering board, to enable the packing ring deviating outward to move back to an axial center of the first tube body to release the first tube body, a top rod structure being provided at an end, away from the upper seat, of the upper tube, and a sheath structure being fixedly disposed at an end, away from the lower seat, of the lower tube, wherein after the telescopic-rod packing device releases the first tube body, the sheath structure of the second tube body is held and pushed toward the first tube body, so that the top rod structure pushes a can body bottom portion of the irritant gas can, to press the press-ring portion to spray the contents.

2. The interlocking telescopic rod defense spray apparatus according to claim 1, wherein an end plug inserted in the through hole is further comprised on a surface, opposite the receiving chamber, of the cap.

3. The interlocking telescopic rod defense spray apparatus according to claim 1, wherein the top rod structure is an end surface of an end, away from the upper seat, of the upper tube.

4. The interlocking telescopic rod defense spray apparatus according to claim 1, wherein a hole is provided on an end surface of an end, away from the upper seat, of the upper tube, the top rod structure of the upper tube is disposed inside the upper tube and sequentially comprises a convex-type element having a top rod, a compression spring, and a fixing element, the fixing element is fixedly screwed on an inner wall of the upper tube, the convex-type element is pushed by the compression spring to enable the top rod to protrude from the hole, and a shortened travel length after the compression spring is pressed is less than a length by which the top rod protrudes from the hole, and in a locking state between the first tube body and the second tube body, the top rod of the convex-type element pushes the can body bottom portion.

5. The interlocking telescopic rod defense spray apparatus according to claim 1, further comprising an umbrella component, wherein the umbrella component comprises a central rod, an umbrella cap, an umbrella handle, a notch, a rib, a cloth, multiple tips, a runner, and a lengthened lower spring for fastening or unfastening the runner, the central rod is a rod body that comprises the first tube body and the second tube body, the umbrella cap is the cap disposed at the first tube body, the umbrella handle is the sheath structure disposed at the second tube body, the notch is sleeved over the head-end portion of the first tube body, the lengthened lower spring is disposed at the lower tube of the second tube body, the runner is sleeved between the notch and the lengthened lower spring and is axially slideable on peripheral surfaces of the first tube body and the lower tube of the second tube body, the rib is connected between the notch and the runner, the cloth and the tips are disposed on the rib, the cloth is opened when the runner moves to a side of the notch, when the runner moves to the lengthened lower spring, multiple fastening holes provided around the runner are used for locking to the lengthened lower spring, so as to fold the cloth, and a distance between a press button and a hook plate of the lengthened lower spring is not less than a pushing distance by which the second tube body pushes the first tube body to spray the contents of the irritant gas can.

6. The interlocking telescopic rod defense spray apparatus according to claim 1, further comprising an umbrella component, wherein the umbrella component comprises a central rod, an umbrella cap, an umbrella handle, a notch, a rib, a cloth, multiple tips, a runner, and an upper spring for fastening or unfastening the runner, the central rod is a rod body that comprises the second tube body and the first tube body and is turned around, the lower tube of the second tube body comprises a segment of an enlarged tube body having a diameter equivalent to that of the first tube body, the umbrella cap is the sheath structure disposed at the second tube body, the umbrella handle is the head-end portion disposed at the first tube body, the notch is sleeved over the sheath structure of the second tube body, the runner is sleeved over the first tube body and is slideable to a periphery of the lower tube of the second tube body and the enlarged tube body, the upper spring is disposed on the enlarged tube body of the lower tube between the notch and the runner, the rib is connected between the notch and the runner, the cloth and the tips are disposed on the rib, when the runner moves to the upper spring, multiple fastening holes provided around the runner are used for locking to the upper spring, so as to open the cloth, and the cloth is folded when the runner moves to the first tube.

7. The interlocking telescopic rod defense spray apparatus according to claim 1, further comprising an umbrella component, wherein the umbrella component comprises a central rod, an umbrella cap, an umbrella handle, a notch, a rib, a cloth, multiple tips, a runner, and a runner locking structure for locking or unlocking the runner, the central rod is a rod body that comprises the first tube body and the second tube body, the umbrella cap is the cap disposed at the first tube body, the umbrella handle is the sheath structure disposed at the second tube body, the notch is disposed at the head-end portion of the first tube body, the runner is disposed at a periphery of the first tube body and the lower tube on a side, facing the sheath structure, of the notch and is axially slideable on peripheral surfaces of the first tube body and the lower tube of the second tube body, the runner locking structure comprises a spiral sheath-lock element that enters the central rod, sheathes the runner, and is freely rotatable, an inner thread is disposed on an inner surface of the spiral sheath-lock element, an external thread is disposed on a surface of the first tube body and corresponds to the spiral sheath-lock element, the rib is connected between the notch and the runner, the cloth and the tips are disposed on the rib, the cloth is opened when the runner moves to the surface of the first tube body and is locked at the external thread, and the cloth is folded when the runner moves to a side, facing the sheath structure, of the external thread.

8. The interlocking telescopic rod defense spray apparatus according to claim 1, further comprising a cane component, wherein the cane component comprises a joint sheath and a cane handle, the joint sheath wraps a surface of a joining area between the first tube body and the lower tube of the second tube body, and the sheath structure of the lower tube is the cane handle.

9. The interlocking telescopic rod defense spray apparatus according to claim 8, wherein a pinhole is provided on a periphery of the lower tube, the pinhole corresponds to an end surface of the joint sheath, a positioning insertion pin component is further comprised, the positioning insertion pin component comprises an insertion pin, removably inserted in a radial direction in a tube body of the lower tube, and stopped at the end surface of the joint sheath, a radially protruding spring ball is provided at a tail end of the insertion pin, a pivotal hole is provided at a head end of the insertion pin, an adjustable clamp ring is pivotally disposed in the pivotal hole, and the adjustable clamp ring is used to pull out the insertion pin, or is held on an outer diameter of the joint sheath.

10. The interlocking telescopic rod defense spray apparatus according to claim 1, further comprising an electrode rod component, wherein the electrode rod component comprises: a battery holder, disposed inside the sheath structure; a battery, placed in the battery holder; a boost circuit, electrically connected to the battery; a pair of electrode needles, disposed on an end surface of the sheath structure, and electrically connected to the boost circuit, multiple electrode plates that correspond to the pair of electrode needles and electrically connected to the pair of electrode needles being disposed on a surface of the sheath structure; a protection lid, covering the end surface of the sheath structure to cover the electrode needles and the corresponding electrode plates; and a circuit switch, disposed in a concave area on a surface of the tube body of the lower tube and not exceeding the surface of the tube body of the lower tube, and electrically connected to the battery, so that the circuit switch is closed to enable the electrode needles and the electrode plates to generate an electric shock.

11. The interlocking telescopic rod defense spray apparatus according to claim 10, wherein a groove for receiving the circuit switch is groove hole perpendicular to a central axis direction of the lower tube, the circuit switch comprises a press-down switch button and a button locking structure, the button locking structure is movable along the groove, a fork portion is provided at an end of the button locking structure, and by means of movement of the button locking structure, the fork portion is kept against a push-down path of the press-down switch button or is removed from the push-down path.

* * * * *